US009827168B2

(12) United States Patent
Honarvar et al.

(10) Patent No.: US 9,827,168 B2
(45) Date of Patent: Nov. 28, 2017

(54) BEVERAGE CONTAINER SYSTEM

(71) Applicants: Cameron Honarvar, Salt Lake City, UT (US); Yuen Seung Hung, Hong Kong (CN)

(72) Inventors: Cameron Honarvar, Salt Lake City, UT (US); Yuen Seung Hung, Hong Kong (CN)

( * ) Notice: Subject to any disclaimer, the term of this patent is extended or adjusted under 35 U.S.C. 154(b) by 0 days.

(21) Appl. No.: 14/679,907

(22) Filed: Apr. 6, 2015

(65) Prior Publication Data

US 2015/0282652 A1 Oct. 8, 2015

Related U.S. Application Data

(60) Provisional application No. 61/976,368, filed on Apr. 7, 2014.

(51) Int. Cl.

| | |
|---|---|
| ***A61J 9/00*** | (2006.01) |
| ***A61J 9/08*** | (2006.01) |
| ***A61J 9/06*** | (2006.01) |
| ***A47G 19/22*** | (2006.01) |

(52) U.S. Cl.

CPC ..... *A61J 9/00* (2013.01); *A47G 19/2272* (2013.01); *A61J 9/001* (2013.01); *A61J 9/06* (2013.01); *A61J 9/0615* (2015.05); *A61J 9/08* (2013.01)

(58) Field of Classification Search

USPC ..... 215/11.1–11.6

See application file for complete search history.

(56) References Cited

U.S. PATENT DOCUMENTS

| | | | | |
|---|---|---|---|---|
| 1,221,335 A * | 4/1917 | Kline | A61J 9/003 | 215/11.6 |
| 2,994,448 A | 8/1961 | Sepe et al. | 215/1 | |
| 3,834,570 A | 9/1974 | Barr | 215/11 E | |
| 4,076,139 A | 2/1978 | Larson | 215/11 C | |
| 4,215,785 A | 8/1980 | Schwaiger | 215/11 C | |
| 4,339,046 A | 7/1982 | Coen | 215/11 B | |
| 4,600,111 A * | 7/1986 | Brown | A47G 19/2272 | 215/11.1 |
| 4,685,588 A | 8/1987 | Kobayashi | 220/428 | |
| 5,038,948 A * | 8/1991 | Signorini | A61J 9/00 | 215/11.1 |

(Continued)

OTHER PUBLICATIONS

Baby Thermos image from http://yankosdesign.com/images/design_news/2009/04/20/baby_thermos_2.jpg and http://www.yankodesign.com/images/design_news/2009/04/20/baby_thermos_3.jpg accessed Dec. 18, 2013 (2 pgs).

(Continued)

*Primary Examiner* — Jeffrey Allen
*Assistant Examiner* — Jennifer Castriotta
(74) *Attorney, Agent, or Firm* — Hayes Soloway P.C.

(57) ABSTRACT

A beverage container system for babies through small children has a thermally insulated outer container which is sized to receive a standard baby bottle and hold it therein with a retainer securable to hold a standard baby bottle. A cap may be positioned over the baby bottle nipple system to protect the nipple. The retainer and standard baby bottle may be removed. An adapter may be thereupon attached to the outer container which can be used with other beverage accessories such as a sippy cup, straw spout and drink tube spout.

7 Claims, 4 Drawing Sheets

(56) References Cited

U.S. PATENT DOCUMENTS

| | | | | |
|---|---|---|---|---|
| 5,156,284 | A | 10/1992 | del Pilar Pla Rodriguez et al. | 215/11.6 |
| 5,180,071 | A * | 1/1993 | Crosson | A47J 41/0072 215/11.1 |
| D404,821 | S | 1/1999 | Azam | D24/197 |
| 5,975,337 | A | 11/1999 | Hadley | 220/592.17 |
| 6,604,649 | B1 | 8/2003 | Campi | 220/739 |
| 7,043,778 | B1 | 5/2006 | Georditsis et al. | 5/93.1 |
| 7,172,086 | B2 | 2/2007 | McKendry et al. | 215/11.5 |
| D546,463 | S | 7/2007 | Potvin | D24/197 |
| 7,669,725 | B2 | 3/2010 | Randolph et al. | 215/12.1 |
| 7,762,413 | B2 | 7/2010 | Song | 215/11.6 |
| 7,909,187 | B2 | 3/2011 | Montgomery | 215/11.1 |
| 8,033,407 | B2 | 10/2011 | Minca | 215/13.1 |
| 8,561,567 | B2 | 10/2013 | Strong | 116/308 |
| 8,573,425 | B1 | 11/2013 | Park | 220/4.05 |
| 8,579,133 | B2 | 11/2013 | Marcus et al. | 215/11.6 |
| 8,618,448 | B2 | 12/2013 | Alexander | 219/432 |
| 2005/0056610 | A1 * | 3/2005 | Randolph | A61J 9/001 215/11.1 |
| 2006/0243694 | A1 | 11/2006 | McKendry et al. | 215/11.1 |
| 2006/0273059 | A1 * | 12/2006 | Mendenhall | A61J 9/00 215/11.1 |
| 2006/0278597 | A1 * | 12/2006 | Daugherty | A61J 9/00 215/11.1 |
| 2008/0093357 | A1 | 4/2008 | Norman et al. | 219/521 |
| 2008/0169688 | A1 | 7/2008 | Funderburg | 297/188.06 |
| 2008/0197097 | A1 | 8/2008 | Montgomery | 215/11.2 |
| 2009/0120894 | A1 * | 5/2009 | Kario | A47G 19/2272 215/11.1 |
| 2010/0206833 | A1 | 8/2010 | Minca | 215/11.6 |
| 2010/0304357 | A1 | 12/2010 | Meyers et al. | 435/4 |
| 2010/0308003 | A1 * | 12/2010 | Morrill | A61J 9/00 215/11.4 |
| 2011/0226802 | A1 * | 9/2011 | Moore | B65D 41/0442 222/1 |
| 2013/0277327 | A1 * | 10/2013 | Fong | A61J 9/04 215/11.5 |

OTHER PUBLICATIONS

Google Image search for "baby thermos" conducted Dec. 18, 2013 (4 pgs).

Thermos Baby Bottle blog (http://thermosbabybottle.blogspot.com) accessed Dec. 18, 2013 (8 pgs).

"Thermos vacuum insulation mug baby straw mug Miffy FEC-280B-R gift" http://global.rakuten.com/en/store/blessyou/item/fec-280b-r accessed Dec. 18, 2013 (2 pgs).

"Foogo by Thermos Plastic Cups" from buybuy Baby http://buybuybaby.com/1/3/foogo-by-thermos-plastic-cups accessed Dec. 18, 2013 (3 pgs).

Thermal Baby Bottle image by Pacific Baby (1 pg).

"Baby bottles" on CosumerReports.org http://constumerreports.org/cro/baby-bottles/buying-guide.htm accessed Mar. 6, 2014 (1 pgs).

* cited by examiner

BEVERAGE CONTAINER SYSTEM

This application is a continuation of U.S. Provisional Patent Application Ser. 61/976,368 filed on Apr. 7, 2014. Applicant claims priority thereto and incorporates specification and drawings thereof the same as if fully set forth herein.

BACKGROUND OF THE INVENTION

1. The Field

A system for dispensing beverages to a user such as a baby to a young child wherein the system includes an outer container sized to receive an inner container like a baby bottle held in the outer container by a retaining structure which may be configured to removably receive a protective and insulating cap and wherein the system includes one or more accessories connectable to the outer container such as a baby bottle nipple, a sippy spout, a straw spout and a drink spout.

2. The Relevant Technology

A variety of baby bottles are known and useful for dispensing beverages to a baby. The beverages may include water, fruit juice, milk and formulas. Other beverages may also be dispensed as desired.

Consumer Reports offers guidance on selecting and buying baby bottles on line at hypertext transfer protocol (http://) having a domain name of comsumerreports.org/ero/baby bottles. The use of thermally insulated bottles has been suggested if one is going to refrigerate to store and to administer/serve certain beverages to a baby at a suitable temperature. The thermal insulating feature may be regarded as useful or desired to keep a particular beverage cool and to keep other particular beverages warm.

At the hypertext transfer protocol site on the world wide web at the domain of buybuybaby.com, one can find "Thermos Plastic Cups;" and at hypertext transfer protocol site having a domain name of global.rukuten.com one can find a "Thermos vacuum insulation mug baby straw mug". A variety of different Thermos baby bottles can also be found at the hypertext transfer protocol site of thermosbabybottle-.blogspot.com and at the world wide web (www) at google-.com/thermosbottles. Pacific Baby Incorporated has also offered a "Thermal Baby Bottle" for a period of time.

As a baby grows, the baby may start to progress from the bottle to small non spillable cups from which the child can sip. The cup is sometimes called a "sippy cup." A number of different types are available as can be seen at the hypertext site (https://) on the world wide web (www) at google.com/sippycup. A sippy cup is one that is made for use by a toddler. It has a closed top with a spout that has a long and wide-mouth piece and allows the toddler to hold and sip from or through the mouthpiece as it chooses. The mouthpiece may be configured with a valve that seals should the cup be dropped.

Straw cups are also known. That is, cups can be configured to hold a straw for access by the user. See the google-.com/strawcupsfortoddlers on the world wide web. Straw cups come in a variety of sizes and shapes and appear to be made of plastic, nylon, or other similar materials.

As babies grow, they pass first into the toddler stage (e.g., age 1-3) where they use sippy cups or straw cups. From toddler age or stage, a child next moves into the small child age or stage (e.g., age 3-5). For the small child age or stage, a drink cup may be selected for dispensing beverage. See google.com/drinkcupfortoddlers where one can see a selection of straw cups, sippy cups and drink cups. Notably, drink cups have a fairly simple centrally disposed spout extending from its cap which the child may place in his/her mouth to receive fluid/liquid/beverage.

Baby bottles are also known to come in different styles and sizes with a standard bottle and a wide bottle being more typical than others. Using the hypertext transfer protocol (http://), you may access the web site comsumerreports.org/cro/babybottles for a discussion of the different types. Other baby bottles may be found disclosed in U.S. Pat. No. 8,618,448 (Alexander), U.S. Patent Application US2010/0206833 published on Aug. 19, 2010 and U.S. Pat. No. 7,172,086 (McKendry).

However, known baby bottles are not adaptable or changeable to or between different sizes and uses. While some come with various attachments to facilitate, for example, carrying, none are known to be convertible between different sizes and for use with other accessories so they can be used from the infant stage through and into the young child age (e.g., about 5 years). An insulated baby or thermally insulated bottle adaptable to hold a standard baby bottle and adaptable or reconfigurable to function as a wide mouth baby bottle and which also is adaptable to receive and function with a variety of accessories including a sippy cup accessory, a straw cup accessory and a drink tube accessory is not known.

BRIEF SUMMARY

A beverage container system includes an inner container, an outer container, retaining structure, an adapter and an accessory. The inner container is configured to hold a beverage having an inner container base and an inner container wall secured to the inner container base to form a first beverage containing volume. A top is removably attachable to the inner container wall. The top has a tip sized to extend away a preselected distance. The top has means for transmitting a beverage from the first beverage containing volume to exterior the top.

The outer container has a base with a wall structure. The wall structure and the base being defined as a second beverage containing volume which is sized to slidably receive the inner container with the top attached thereto. The outer container has container securing structure formed proximate an upper rim. The container securing structure is configured for securing a retaining structure thereto.

The retaining structure is sized to position over the inner container to retain the inner container in the outer container when the inner container is positioned in the outer container. The retaining structure has first retainer securing structure configured to mechanically cooperate with the container securing structure to secure the retaining structure to the outer container and retain the inner container in the outer container. The retaining structure has an aperture sized to receive the tip therethrough.

The adapter has a first end with container securing means proximate thereto. The container securing means is configured to mechanically cooperate with the container securing structure to effect a sealing connection between the outer container and the first end of the adapter. The adapter also has a second end with a first accessory securing means positioned proximate to the second end for securing accessories thereto.

The beverage container system includes accessories or may be configured to use accessories such as a wide mouth baby bottle assembly, a sippy spout, a straw spout and a drink tube.

BRIEF DESCRIPTION OF THE DRAWINGS

To further clarify the above and other advantages and features of the present invention, a more particular description of the invention will be rendered by reference to the appended drawings. It should be understood that the drawings depict only typical embodiments and therefore is not to be considered limiting of the scope of the appended claims. More specifically:

DESCRIPTION

Figure 1:
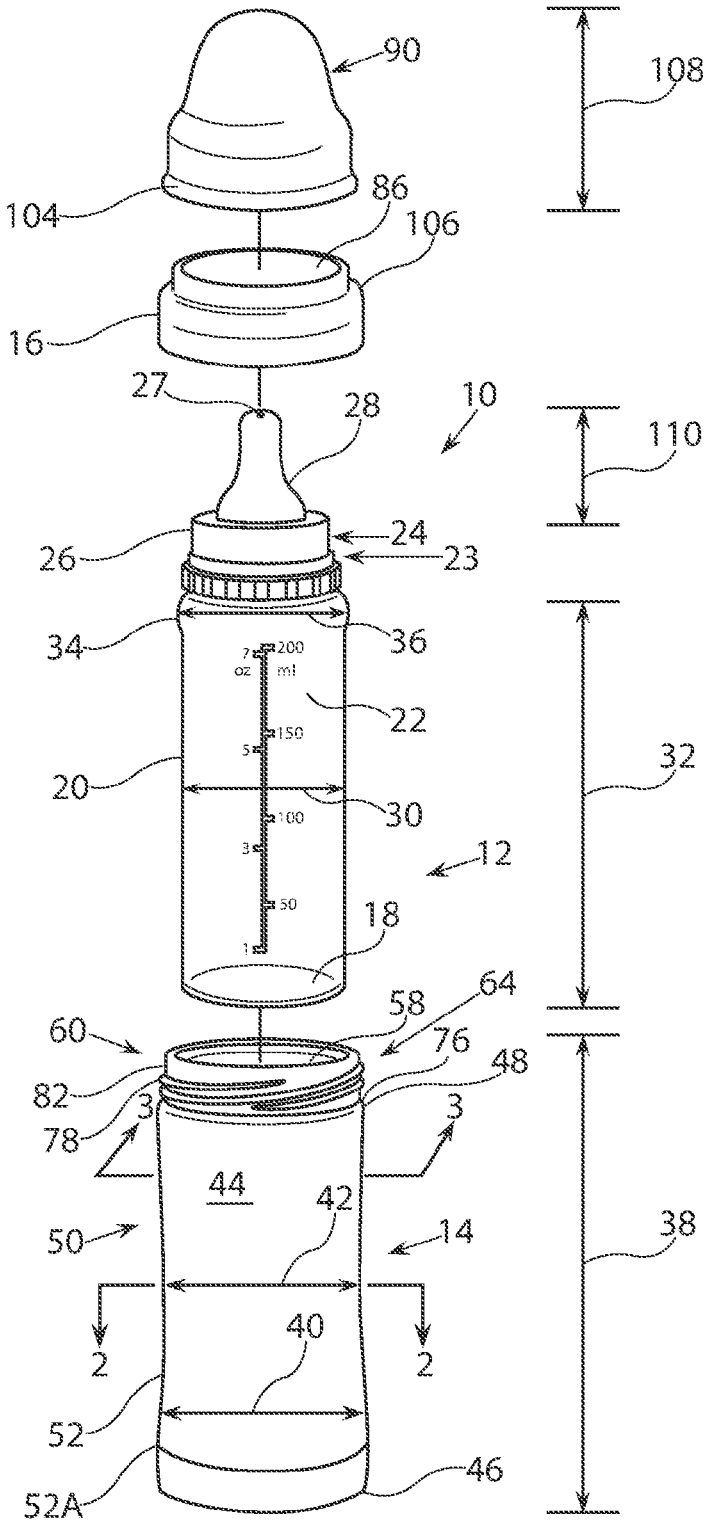
FIG. 1 is an exploded view of a beverage container system configured for use with a standard baby bottle.

FIG. 1 depicts a beverage container system in a first configuration 10 in which an inner container 12 is positioned in an outer container 14. The inner container 12 is retained in the outer container 14 by retaining structure which is here shown as a retainer 16.

The inner container 12 is shown as a cylindrical standard sized baby bottle having an inner container base 18 unitarily formed with an inner container wall 20 to form an inner container volume 22 for retaining beverages therein. The inner container base 18 and inner container wall 20 are here made of a suitable plastic or plastic like material that is washable and preferably one that may be sterilized. It may also be made of glass or any other material which is suitable for holding beverages of type that are provided to a baby. The inner container wall 20 has suitable markings in both fluid ounces and in millimeters so that one may be able to mix or combine certain volumes of beverages or mix ingredients. The top of the inner container wall is formed into a mouth 23 which typically has threads (not shown) sized to interact with similar threads (not shown) formed in the top 24. The threads are sized to cooperate mechanically so the top 24 may be threaded onto the mouth 23 of the inner container 12 to effect a sealing connection. When threaded tightly to effect a sealing connection, the inner container 12 may be tipped or oriented so that a beverage securely in the inner container volume 22 does not leak past the top 24 but is held in the inner container volume and/or the top 24.

As stated, the top 24 is removably attachable to the mouth 23 at the top of the inner container wall 20. While a threaded connection is described, other forms of a sealable connection may be used as desired so long as they effect a removable water resistant connection. The top 24 is here shown to have a base 26 and a tip 28 which, as shown, is a standard baby nipple formed with a flange like structure sized to be sealingly urged against the mouth of the inner container 12 as the base 26 is threaded onto the mouth 23 to effect a seal between the top 24 and the inner container 12. As a standard baby bottle nipple, a small aperture 27 is formed in the top 24 so that a beverage from the beverage containing volume 22 may be withdrawn by the user sucking on the tip 28 or by other suitable manipulation of the tip 28.

It may be appreciated that the combination of the top 24 and the inner container 12 is typically referred to as a standard baby bottle. Other forms of bottles of similar size and shape may be used if desired. Notably the inner container 12 is shown to be generally cylindrical in shape having a diameter 30 and a height 32 selected for ease of placement into the outer container 14 as discussed hereinafter. While the inner container 12 is shown to be generally cylindrical, other geometric shapes may be used so long as they are sized to fit into the outer container 14.

It may also be noted that the inner container 12 has a diameter 36 near the mouth 23 creating in effect a rounded shoulder 34. The rounded shoulder 34 is provided to facilitate handling of the inner container 12 when the exterior surface of the inner container wall 20 is slippery.

Figure 2:
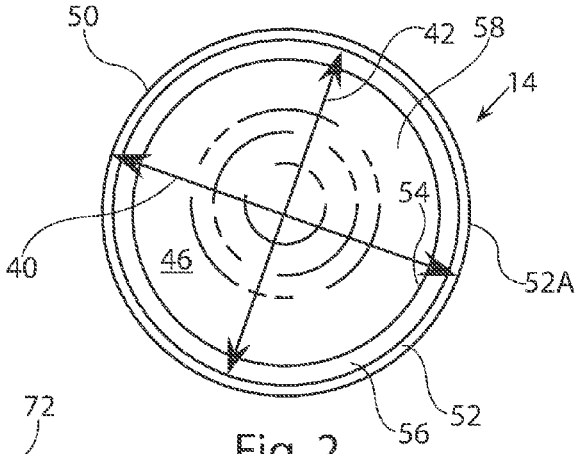
FIG. 2 is a cross sectional view at section lines 2-2 of the outer container of the beverage container system of FIG. 1.

Turning now to the outer container 14, it is shown to be generally cylindrical in shape having a height 38 and a circular cross section (see FIG. 2). While circular in cross section, the outer container 14 has a larger diameter 40 proximate the bottom 46 and the top 48 and a smaller diameter 42 proximate the middle 50 of the outer container 14 so that the outer container 14 has a slight hour glass shape. The hour glass shape is provided to enhance the appearance and to provide for ease of grasping when the outer surface 44 of the outer container 14 is slippery.

As better seen in FIG. 2, the outer container 14 is formed with an outer wall 52 and an inner wall 54. The outer wall 52 curves outwardly toward the bottom area 52A near the bottom 46; and the outer wall 52 forms or defines the outer surface 44. The outer wall 52 and inner wall 54 are sealed to form a thermally insulating volume 56 that is evacuated so that the outer container 14 preferably becomes a thermally insulating container. That is, with the air removed from the thermally insulating volume, heat transmission through the volume 56 is inhibited so that cold or hot liquids may retain their desired thermal characteristics for a longer period of time. That is, heat transmission through the outer wall 52 and inner wall 54 is reduced so that the hot beverages (above ambient air temperature) in the interior 58 remain hot longer and cold beverages (below ambient air temperature) remain cold longer.

While the outer container 14 may be formed of materials having suitable strength including metals, nylons and plastics, it is preferred to form the outer container 14 from a suitable metal alloy such as 304 stainless steel or 18/8 stainless steel. Assembly can be easily accomplished by using laser welding procedures to join and create a seamless inner wall 54 which is easier to clean. Further, the outer surface 44 of the outer wall 52 of the outer container 14 may thus be more easily decorated by using electro-deposition techniques. Use of stainless steel is also preferred for the outer container 15 because it thereby has sufficient structural strength to withstand the forces experienced when dropped from a high chair or table to a solid floor. And with the interior surface of the inner wall 54 formed as stated with no seams, the risk of contamination is reduced. The smooth interior surface of the inner wall 54 in effect facilitates cleaning and sterilization.

Figure 3:
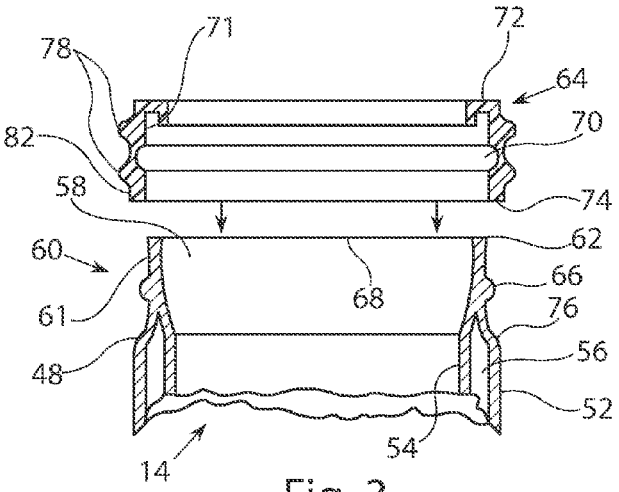
FIG. 3 is a cross sectional view at section lines 3-3 of the outer container of the beverage container system of FIG. 1.

In FIG. 3, the outer container 14 has a mouth 60 near the top 48. The mouth 60 is formed by an upper rim 62 providing access to the interior 58 of the outer container 14 which is the second beverage containing volume. The second beverage containing volume is sized to receive and hold a quantity of beverage comparable to and virtually the same as a wide mouth baby bottle. The interior 58 is defined by the bottom 46 and the inner wall 54. While the volume 58 is selected to be effectively the same as a wide mouth baby bottle, it may be selected to any size desired so long as the inner container 12 is able to fit therein.

As seen in FIGS. 1 and 3, a container securing structure is positioned over the rim 62 and snuggly about the outer surface 61 near the mouth 60. The container securing structure is here shown as the thread structure 64 configured for threadedly receiving retaining structure like retainer 16. In FIG. 3, the thread structure 64 is shown exploded or spaced away from the rim 62 for clarity.

The upper rim 62 is formed with a friction ring 66 that extends around the entire perimeter 68 on the outer surface 61 below the upper rim 62. The friction ring 66 is spaced below the rim 62 a distance selected so that it will register with and cooperatively interact with a detent 70 formed in the inner surface 71 of thread structure 64. The thread structure 64 is formed to have a diameter or slightly larger than the diameter of the upper rim 62 and the outer surface 61 so that when the thread structure 64 is urged and over the upper rim 62 and outer surface 61, the thread structure 64 is securely held in place.

The removable thread structure 64 seen in FIG. 3 has a lip 72 which is sized and shaped to snuggly receive and fit over the upper rim 62 while the bottom 74 abuts the shoulder 76 formed at the top 48 of the outer container 14. That is, the outer wall 52 of the outer container 14 is shaped near the top 48 (FIG. 1) to form the shoulder 76 and effect a smooth transition from the thread structure 64 to the outer wall 52 to minimize cracks and gaps into which undesired material may proceed which a user typically would prefer to remove.

The thread structure 64 has threads 78 that extend around the exterior surface 82 of the thread structure 64 in a pattern to mechanically interact with corresponding threads 80 formed on the inner surface 84 of the retainer 16. Upon placement of the inner container 12 into the interior 58 of the outer container 14, the sizing of the inner container 12 and the outer container 14 is such that the tip 28 extends thru the aperture 86 (FIG. 1) of the retainer 16 when it is threaded on the thread structure 64 while the inner container 12 is held snuggly in place in the interior 58 of the outer container 14 by the retainer 16.

Figure 4:
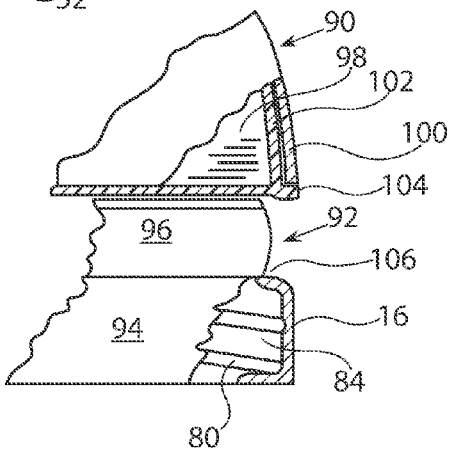
FIG. 4 is a partial exploded view of retaining structure with a cut away portion and cap of the beverage container system of FIG. 1 with a cut away portion.

As seen better in FIGS. 1 and 4, a cap 90 is shown for positioning over the tip 28 for removable attachment to the retainer 16. The retainer 16 has a cap lock structure 92 unitarily formed with the base 94. The cap lock structure 92 extends away from or upward from the base 94 and has an exterior surface 96 which can be seen in FIG. 4 to be slightly arcuate or convex to frictionally receive the interior surface 98 of the cap 90. As will be seen, the interior surface 98 of the cap 90 frictionally engages and elastically deforms as it passes over the surface 96.

In FIG. 4, the cap 90 is shown to have an exterior skin 100 which may be made of any suitable rigid material which may be a plastic or metal. In the preferred configuration, the skin 100 is made of 304 stainless steel with a plastic (e.g., polypropylene) liner 102 formed to snuggly fit therein. The plastic liner 102 effectively is positioned against the inner surface of the exterior skin 100. The combination of the plastic liner 102 and the skin 100 with the air interior of the surface 98 function to insulate and inhibit the transfer of heat out of or into the beverage in the first beverage containing volume such as inner container volume 22.

As best seen in FIG. 4, the plastic liner 102 has a liner lip 104 which is sized to abut the shoulder 106 formed by the base 94 and the cap lock structure 92 of the retainer 16 when the cap 90 is in place secured to the retainer 16. The cap 90 has a height 108 selected to receive the tip 28 with height 110 therewithin. That is, the height 108 is selected so that the tip 28 is not compressed or deformed in any way when the cap 90 is attached to the retainer 16. At the same time, with the cap 90 mechanically locked in place, any leaked beverage through the aperture 27 will be retained within the cap 90. Thus in use, it is typically recommended to hold the assembly of FIG. 1 with the cap down and the outer container 14 up while removing the cap 90 from the retainer 16.

Figure 5:
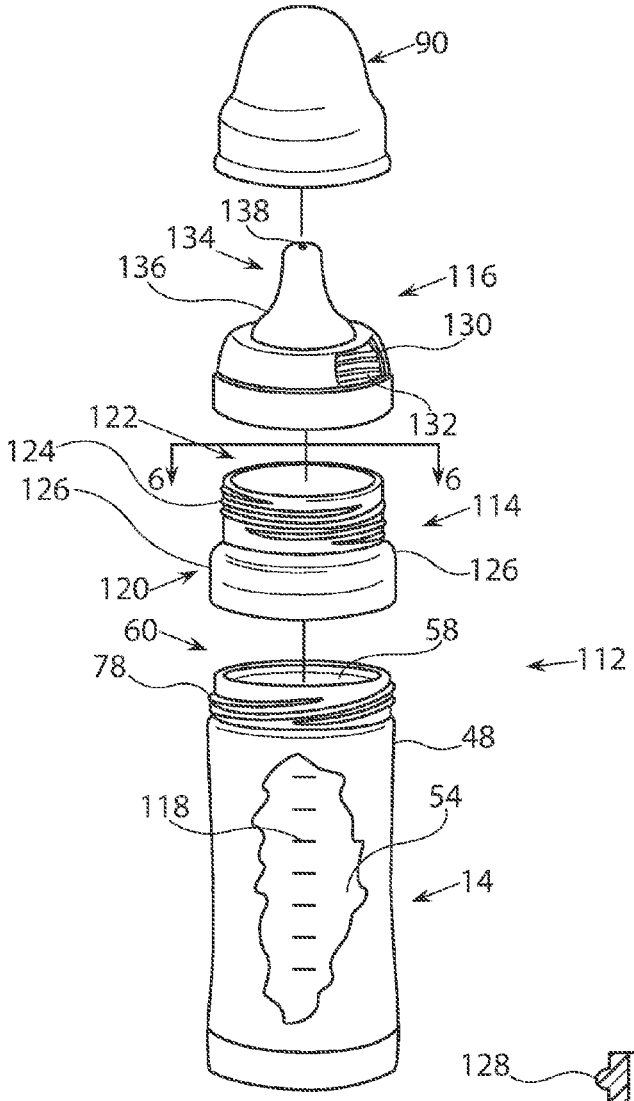
FIG. 5 is an exploded view of the beverage container system of FIG. 1 reconfigured for use as an alternate size baby bottle and with a cut out portion.

FIG. 5 depicts the beverage container system in a different configuration or alternate baby bottle configuration 112 to function as a baby bottle sized and configured differently from in inner container 12 assembled with a top 24. That is, the outer container 14 is now assembled with an adapter 114, a wide mouth baby bottle nipple assembly 116 and the cap 90.

The outer container 14 in FIG. 5 is shown with a cutaway portion so that one can see volume markings 118 that are stamped into the inner surface 54 and are visible through the mouth 60 when filling. The volume markings 118 may be in fluid ounces or in milliliters, or both.

Figure 6:
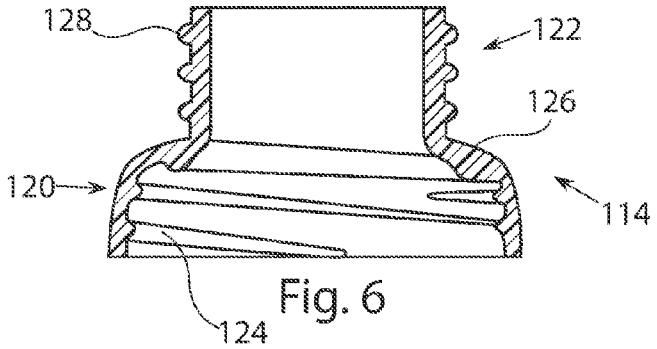
FIG. 6 is a cross sectional view at section lines 7-7 of an adapter for use with the beverage container system of FIG. 1.

The adapter 114 also seen in section in FIG. 6 has a first end 120 formed with container securing means and a second end 122 formed with accessory securing means for securing accessories thereto such as the wide mouth baby bottle nipple assembly 116. As hereinafter discussed, other accessories may be secured to the accessory securing means.

As better seen in FIG. 6, the first end 120 of the adapter 114 is formed with container securing means to secure the adapter to a container like outer container 14. As here shown, the container securing means is first end threads 124 which are sized and shaped to interact with the threads 78 of the thread structure 64 secured to the top 48 of the outer container 14. Thus the adapter 114 may be removably threaded onto the outer container 14 to effect a scaling connection to and with the outer container 14.

The second end 122 of the adapter 114 is unitarily formed with the first end 120 and is preferably formed from plastic such polypropylene or a similar plastic or plastic-like material that has a smooth, non porous exterior surface 126. The second end 122 has first accessory securing means which is here shown as threads 128 sized and shaped to interact with and effect a leak resistant connection with the wide mouth baby bottle assembly 116. Thus, when assembled, a beverage from the second beverage containing volume which is the interior 58 of the outer container 14 may pass through the hollow interior of the adapter 114 and through the hollow interior of the wide mouth baby bottle assembly 116 and out the aperture 138.

The wide mouth baby bottle assembly 116 has a base 130 formed with threads 132 formed on its interior surface as seen in the cut out portion of FIG. 5. The threads 132 are sized to engage and cooperate with the first end threads 124. The wide mouth baby bottle assembly 116 also has a conventional nipple structure 134 having a top 136 with an opening 138 to receive and pass to exterior the top 136 a beverage positioned in the interior of the outer container 14. The base 130 is sized to snuggly receive and hold the cap 90 thereto. In effect, the beverage containing system of FIG. 5 when assembled has a fluid volume and comparable to that of and functions comparable to a wide mouth baby bottle.

Figures 7, 8, 9:
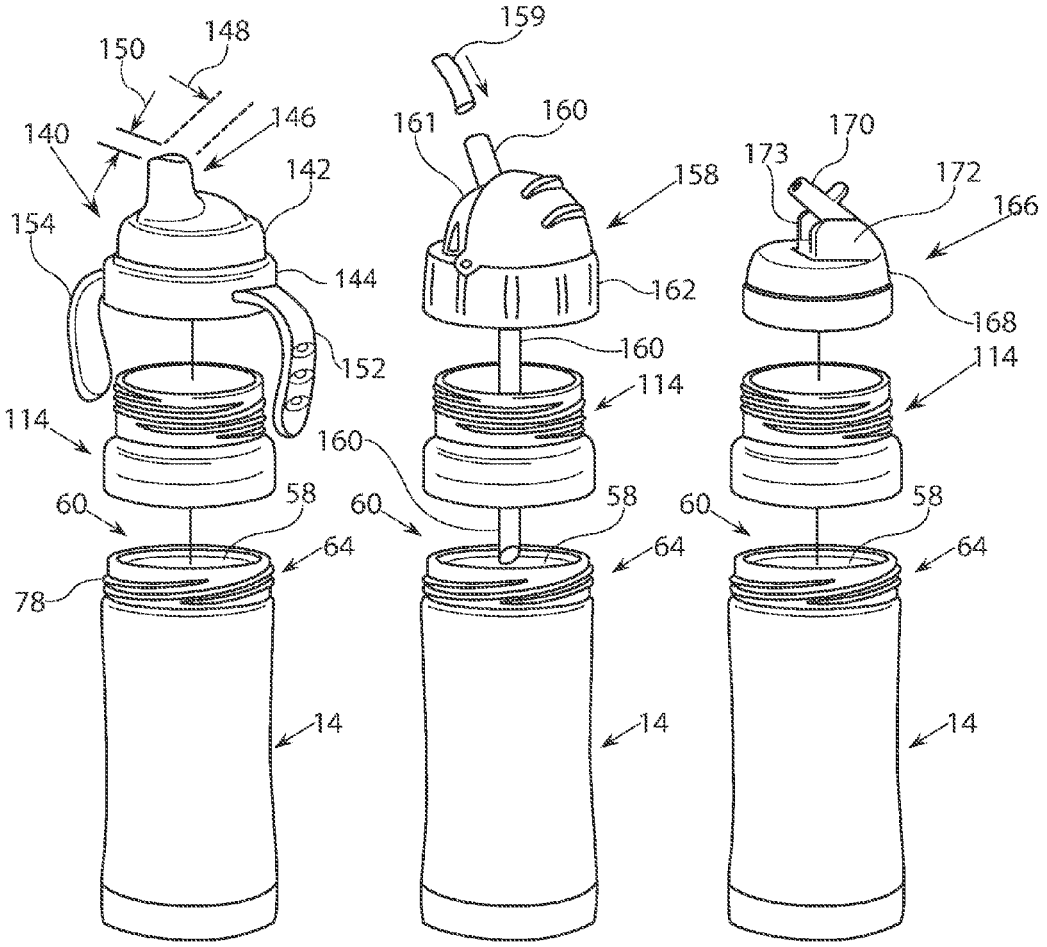
FIG. 7 is an exploded view of the beverage container system of FIG. 1 reconfigured for use as a sippy cup.
FIG. 8 is an exploded view of the beverage container system of FIG. 1 reconfigured for use as a straw cup.
FIG. 9 is an exploded view of the beverage container system of FIG. 1 reconfigured for use as drink cup.

In reference to FIGS. 7, 8 and 9, each shows an exploded view of a beverage container system with a different accessory. That is, the outer container 14 and the adapter 114 are the same as hereinbefore described. In FIG. 7, the accessory shown is a sippy cup accessory 140. It has a top 142 unitarily formed with a base 144 which has threads formed on the interior comparable to threads 132 of the base of the wide mouth baby bottle assembly 116 so that the sippy cup accessory may also attach to the adapter 114 and effect a liquid resistant connection and seal. The sippy cup accessory 140 has a spout 146 having a width 148 and a thickness 150 sized for the mouth of a toddler. The spout 146 may also have a check valve in it to minimize spilling from the spout when in use.

The base 144 of the sippy cup accessory 140 has two spaced apart handles 152 and 154. Thus a child may manipulate the handles 152 and 154 to hold the beverage container system configured as seen in FIG. 7 and assembled to drink from the spout 146 unaided by others. That is, the beverage flows from the interior 58 of the outer container 14 through the adapter 114 and the sippy cup accessory 140 to the spout 146 of the sippy cup accessory.

In FIG. 8, a straw accessory 158 is shown configured for use with a straw 159 that is positioned through the straw receiver 160 in the hemispherical top 161. The straw 159 extends into the interior 58 of the outer container 14. The straw accessory 158 also has a base 162 that is sized and formed with threads comparable to base 130 of the wide mouth baby bottle assembly 116. Thus, the straw accessory 158 may be threaded onto the adapter 114 to effect a liquid resistant seal with the adapter 114 and more particularly the threads 124 of the adapter 114.

Turning now to FIG. 9, the accessory shown is a drink tube accessory 166 is shown which has a base 168 with threads comparable to base 130 of the wide mouth baby bottle assembly 116. A cylindrical spout 170 is hingedly positioned between supporting side walls 172 and 173 so that it may be urged between a down and closed position and an open or raised position as shown in FIG. 9. When in the raised or open position, it is in fluid communication to receive beverage through the base 168 and adapter 114 from the interior 58 of the outer container 14.

It should be understood that threaded connections have been shown and described to associate or connect the retainer 16 to the outer container 14, to associate the top 24 to the inner container 12, top connect the adapter 114 to the outer container 14 and to connect accessories to the adapter 114. Other forms of connection may be used in lieu of threads including a detent and groove structure as well as a multiple 'O' ring arrangement. In other words, the threaded connections have been shown to facilitate a removable yet leak resistant connection. Other forms or structures to effect leak resistant connections between accessories like the wide mouth baby bottle nipple assembly 116 may be used so long as the resulting connection is leak resistant and easy to operate.

The invention claimed is:

1. A beverage container kit having components which can be assembled into multiple configurations, said kit comprising kit components including:

an outer container defining an outer container volume sized to receive one of a baby bottle and an outer container beverage, said outer container having an outer container opening, said outer container having an outer wall and an inner wall spaced from the outer wall, and said outer wall being made from a rigid material and in a hour glass shape, and said outer wall having a friction ring formed proximate said outer container opening;

a container securing structure having a detent to register with said friction ring for removable attachment of said container securing stricture to said outer container proximate said aperture, said container securing structure having external securing means for securing one of a retaining structure and an adapter thereto;

a baby bottle sized to fit into said outer container volume, said baby bottle having a baby bottle volume for containing a baby bottle beverage, said baby bottle having a baby bottle opening;

a baby bottle top removably and sealably attachable to said baby bottle at said opening, said baby bottle top having a nipple sized to extend away therefrom a preselected distance, said baby bottle top being in fluid communication with said baby bottle volume when attached to said baby bottle, said nipple being configured to transmit said baby bottle beverage from said baby bottle volume to exterior said baby bottle top;

said retaining structure configured to mechanically attach to said container securing structure to secure said baby bottle with said top attached thereto in said outer container volume, said retaining structure having cap lock structure associated therewith for removably securing a cap thereto;

a cap formed to removably attach to said cap lock structure, said cap being formed to retain said nipple therewithin;

said adapter having adapter securing means for securing said adapter to said container securing structure, and said adapter having accessory securing means for attaching an accessory to said adapter;

said accessory being formed and configured for transmitting said outer container beverage from said outer container volume to a user, said accessory having accessory securing means configured to effect a sealing connection between said accessory and said adapter;

wherein a selection of said kit components are assemblable into a first configuration in which said baby bottle with said baby bottle top attached thereto is positioned in said outer container and said retaining structure is attached to said outer container securing structure to retain said baby bottle in said inner container volume with said baby bottle nipple extending away from said retaining structure;

wherein a selection of said kit components are assemblable into a second configuration that is said first configuration with said cap attachable to said cap lock structure; and wherein a selection of said kit components are assemblable into a third configuration in which said outer container beverage is positioned in said outer container volume, said adapter is secured to said container securing structure and said accessory is attached to said adapter.

2. The beverage container kit of claim 1 wherein said accessory is a baby bottle nipple assembly having a base and a nipple structure with a nipple top, said base having means for attaching to said adapter and to hold said nipple structure securely to said adapter with said nipple top extending therefrom, and wherein said base is formed for removably attaching said cap thereto; and wherein a selection of said kit components are assemblable into a configuration that is said third configuration in which said accessory is said baby bottle nipple assembly.

3. The beverage container kit of claim 1 wherein said accessory is a sippy cup structure with a mouth for delivering said outer container beverage to outside said sippy cup, and wherein a selection of said kit components are assemblable into a configuration that is said third configuration in which said accessory is said sippy cup structure.

4. The beverage container of claim 1 wherein said accessory is a straw accessory configured for introduction of a straw into said outer container volume and wherein a selection of said kit components are assemblable into a configuration that is said third configuration in which said accessory is said straw accessory.

5. The beverage container kit of claim 1 wherein said accessory is a drink tube with a spout having an aperture in fluid communication with said outer container volume and wherein a selection of said kit components are assemblable into a configuration which is said third configuration in which said accessory is said drink tube.

6. The beverage container kit of claim 1 wherein said cap has an exterior skin with an interior surface and a liner positioned against said interior surface.

7. The beverage container kit of claim 1 wherein said outer wall has an upper rim, wherein said outer wall has a friction ring formed proximate the upper rim, and wherein said container securing structure has a detent positioned to register with said friction ring when positioned on said outer container proximate said outer container aperture.

* * * * *